US012662639B2

(12) United States Patent
Yang et al.

(10) Patent No.: US 12,662,639 B2
(45) Date of Patent: Jun. 23, 2026

(54) METHODS AND SYSTEMS FOR PROCESSING HYDROCARBON STREAMS

(71) Applicant: EXXONMOBIL CHEMICAL PATENTS INC., Baytown, TX (US)

(72) Inventors: Yuti L. Yang, Houston, TX (US); Edison A. Rincon, Humble, TX (US)

(73) Assignee: EXXONMOBIL CHEMICAL PATENTS INC., Baytown, TX (US)

( * ) Notice: Subject to any disclaimer, the term of this patent is extended or adjusted under 35 U.S.C. 154(b) by 407 days.

(21) Appl. No.: 18/269,895

(22) PCT Filed: Jan. 3, 2022

(86) PCT No.: PCT/US2022/011028

§ 371 (c)(1),
(2) Date: Jun. 27, 2023

(87) PCT Pub. No.: WO2022/155019

PCT Pub. Date: Jul. 21, 2022

(65) Prior Publication Data

US 2024/0043760 A1 Feb. 8, 2024

Related U.S. Application Data

(60) Provisional application No. 63/138,689, filed on Jan. 18, 2021.

(51) Int. Cl.
*C10G 55/04* (2006.01)

(52) U.S. Cl.
CPC ..... *C10G 55/04* (2013.01); *C10G 2300/1081* (2013.01); *C10G 2300/208* (2013.01);
(Continued)

(58) Field of Classification Search
CPC ..... C10G 55/04; C10G 2300/1081; C10G 2300/208; C10G 2300/308; C10G 2300/4081; C10G 9/00
See application file for complete search history.

(56) References Cited

U.S. PATENT DOCUMENTS

2006/0014993 A1* 1/2006 Stell ..... C10G 9/00 208/132
2018/0057759 A1 3/2018 Kandel et al.
2018/0320088 A1* 11/2018 Spicer ..... B01J 19/2415

OTHER PUBLICATIONS

Pall Coalescer (Year: 2009).*

(Continued)

*Primary Examiner* — Randy Boyer
*Assistant Examiner* — Juan C Valencia
(74) *Attorney, Agent, or Firm* — WOMBLE BOND DICKINSON (US) LLP; Kevin Davis

(57) ABSTRACT

The present disclosure relates to a method of processing hydrocarbons including depressurizing a hydrocarbon stream, vaporizing at least a portion of a non-vapor phase hydrocarbon of the stream, and separating first and second products. The first product includes at least a portion of the vaporized stream's vapor phase hydrocarbon that became vapor during the vaporization, and the second product includes at least a portion of the vaporized stream remaining as non-vapor during the vaporization. The separation includes a gross separator such as a cyclone, a vane pack device, a knock-out drum optionally having a demister pad, or combination(s) thereof. Non-vapor phase droplets of the first product are removed from the first product of the stream using coalescing elements before processing in a pyrolysis reactor.

24 Claims, 5 Drawing Sheets

(52) U.S. Cl.
CPC ..... *C10G 2300/308* (2013.01); *C10G 2300/4081* (2013.01)

(56) References Cited

OTHER PUBLICATIONS

BOP-X Feed Coalescer Technology Basis Memorandum, Grid Level 2, May 20, 2013, 20 pages, Elisabeth A. Walker.
BOP-X Feed Coalescer Update, Yuti Yang, Nov. 19, 2015, 11 pages.

* cited by examiner

METHODS AND SYSTEMS FOR PROCESSING HYDROCARBON STREAMS

CROSS-REFERENCE TO RELATED APPLICATIONS

This application is a US national phase application of PCT Application Serial No. PCT/US2022/011028 having a filing date of Jan. 3, 2022, which claims priority to and the benefit of U.S. Provisional Application No. 63/138,689 having a filing date of Jan. 18, 2021, the disclosures of all of which are incorporated herein by reference in their entireties.

FIELD

The present disclosure generally relates to methods and systems for managing impurities in the processing of hydrocarbon streams.

BACKGROUND

The oil and gas industry continuously seeks to efficiently obtain and process hydrocarbons into products. These processes generally involve the use of thermal changes and/or pressure changes to separate the hydrocarbons in various process stages. In particular, the processing may be performed in an oil refinery, which converts or separates the hydrocarbons (e.g., crude oil) into different streams, such as gases, light naphtha, heavy naphtha, kerosene, diesel, atmospheric gas oil, asphalt, petroleum coke and heavy hydrocarbons. Similarly, if the processing is performed in a natural gas refinery, the natural gas may be converted into industrial fuel gas, ethane, propane, butanes and pentanes.

As part of the processing of the hydrocarbon stream, the hydrocarbons can be transported via conduits and/or pipes from another location within the facility and/or a location outside of the facility. For example, the hydrocarbon stream can be an ethane or propane stream, and can be transported via a pipeline grid system at high pressure in the super critical state. This high pressure ethane or propane stream can also be referred to as "dense phase" ethane or propane. If the hydrocarbon stream is provided at this high pressure, it may have to be depressurized prior to feeding to a pyrolysis reactor.

Typical steam cracking pyrolysis processes often accumulate "coke" in the radiant tubes during high temperature pyrolysis. The extent and rate of coke accumulation limits pyrolysis reactor reliability and operating conditions. When processing ethane or other gas feeds in steam cracking pyrolysis reactors, heavy hydrocarbon liquid is a feed contaminant which results in a high radiant coking rate and short reactor run-length resulting in offline down time to steam air decoke the radiant tubes. When heavy hydrocarbon liquid is processed under gas cracking conditions, it is severely over-cracked and turns into coke. This additional coke adds to the base coke accumulation in a pyrolysis reactor. Currently, knock-out drums are used to remove impurities from the feed to the pyrolysis reactor, however, knock-out drums are not equipped to remove high viscosity components. Thus, there is a need for methods and systems for managing impurities in processing hydrocarbon streams for a pyrolysis reactor, such as a steam cracking furnace or a regenerative reverse flow reactor.

SUMMARY

In at least one embodiment, a method of processing hydrocarbons includes vaporizing at least a portion of a non-vapor phase hydrocarbon of a hydrocarbon stream to form a second stream having the hydrocarbon stream's hydrocarbon that is vaporized during the vaporization. The method includes separating a first product and a second product from the second stream. The first product includes at least a portion of the second stream's vapor phase hydrocarbon (that became vapor during the vaporization) and at least a portion of non-vapor phase compositions (e.g., remaining as droplets), and the second product includes at least a portion of the second stream remaining as non-vapor during the vaporization. The portion of the non-vapor phase compositions (e.g., droplets) in the first product can be removed from the first product to form a third product. The third product can be pyrolysed to produce a fourth product having saturated and unsaturated hydrocarbon.

In another embodiment, the present disclosure relates to a method of producing an alkene including depressurizing an alkane stream to form a mixed phase stream and vaporizing at least a portion of the mixed phase stream to form a vaporized stream. The method includes separating a first product and a second product from the vaporized stream, the first product having at least a vapor portion of the vaporized stream's vapor phase hydrocarbon (that became vapor during vaporization) and non-vapor phase droplets. The second product includes at least a non-vapor portion of the vaporized stream remaining as non-vapor during the vaporization. Separating the first product and the second product from the vaporized stream can include filtering the first product from the mixed phase stream with cyclonic devices, vane pack devices, a knock-out drum with or without demister pads, or combination(s) thereof. The portion of the non-vapor droplets in the first product can be removed from the first product in a coalescer having coalescing elements to form a third product. The third product with steam can be pyrolysed to form a fourth product under pyrolysis conditions that include a temperature of about 815° C. to about 925° C. in a pyrolysis reactor to produce $C_{2+}$ unsaturates.

In another embodiment, the present disclosure relates to a hydrocarbon processing system including a depressurization unit configured to reduce a pressure of a hydrocarbon stream. The hydrocarbon processing system includes a vaporization unit in fluid communication with the depressurization unit. The vaporizing unit is configured to vaporize a portion of a non-vapor phase hydrocarbon of the hydrocarbon stream. A separation system is in fluid communication with the vaporizing unit and the separation system can include coalescing elements. A pyrolysis reactor is in fluid communication with the separation system for further processing, such as steam cracking.

In another embodiment, the present disclosure relates to a system for producing alkenes from alkanes including a first heat exchanger in fluid communication with an alkane stream feed configured to heat an alkane stream. A depressurization unit in fluid communication with the first heat exchanger is configured to reduce a pressure of the alkane stream. The system can include a vaporizing unit in fluid communication with the depressurization unit and configured to vaporize a portion of a non-vapor phase hydrocarbon of the alkane stream. The system can include separation system in fluid communication with the vaporizing unit, the separation system having coalescing elements. A pyrolysis reactor is in fluid communication with the separation system.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one example may be beneficially incorporated in other examples without further recitation.

DETAILED DESCRIPTION

Figure 1:
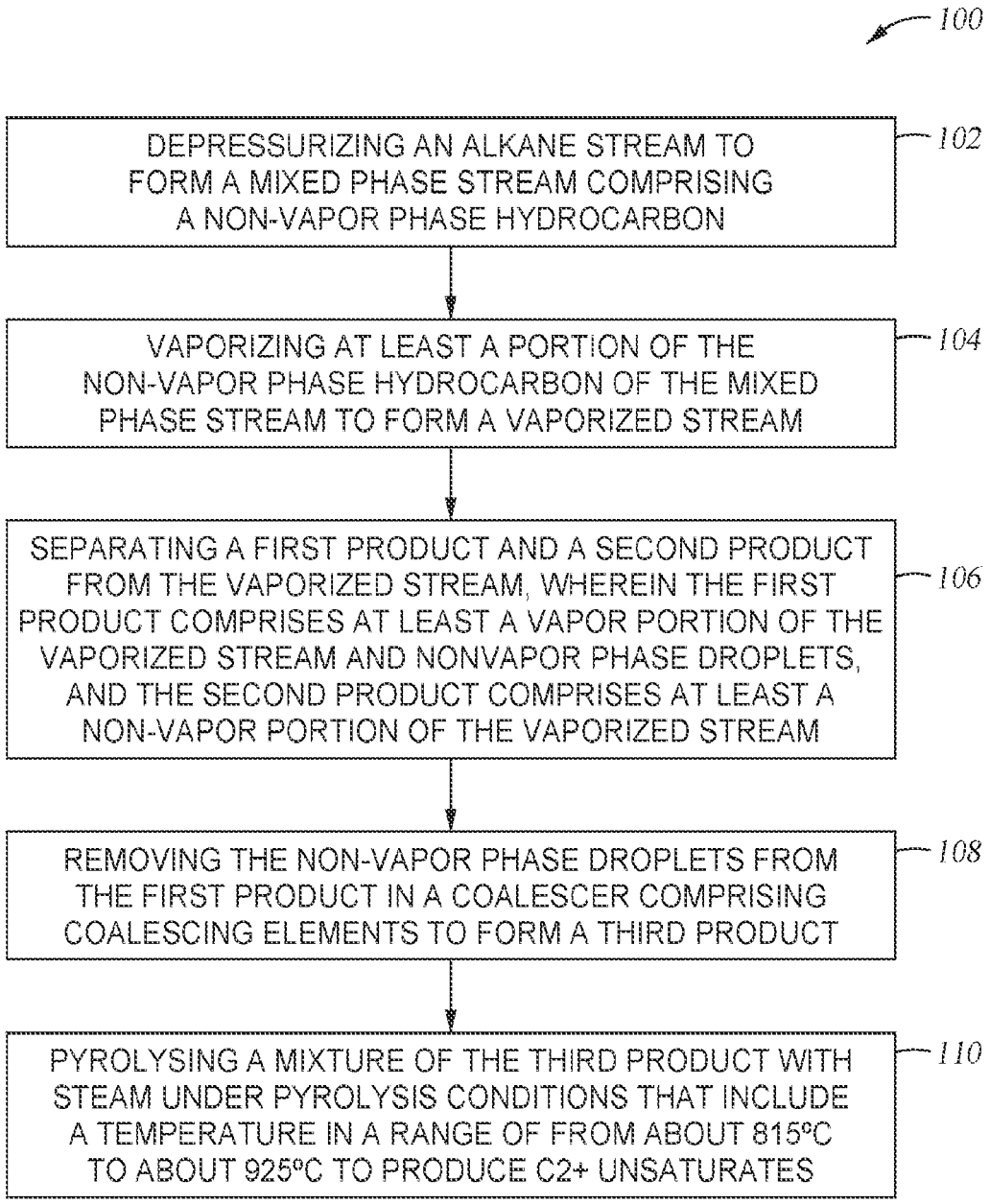
FIG. 1 depicts a flow diagram 100 of an example method of processing a hydrocarbon stream in accordance with some aspects of the present disclosure.

The present disclosure provides a method and system for managing impurities in hydrocarbon streams during processing. In particular, the present disclosure provides a separation system to remove contaminants from dense phase feeds to improve hydrocarbon processing performance A separation system may be installed downstream of a pressure let down (e.g., depressurizer) and downstream of a hydrocarbon vaporizer to provide separation, as certain components such as lube oils are highly soluble in dense phase hydrocarbon feeds. Moreover, the separation system of the present disclosure may separate impurities using at least two stages. The first stage removes particulates and incoming liquid, and the second stage removes fine-mist and droplets such as oil and glycol at low pressure drop. In some embodiments, the coalescer includes one stage, or two stages, or three stages. A first stage can include a knock-out drum, a second stage can include cyclone(s), and a third stage can include coalescing elements. In some aspects of the present disclosure, the separation system delivers an upgraded hydrocarbon stream reducing coking that occurs during processing of the hydrocarbon stream. Supplying upgraded hydrocarbon streams to processes such as a pyrolysis reactor can allow an operating plant to expand operating windows, optimize recovery operations with higher conversion and fewer recycles and optimize energy usage through reduced dilution steam.

Unless otherwise stated, all percentages, parts, ratios, etc., are by weight. Unless otherwise stated, a reference to a compound or component includes the compound or component by itself, as well as in combination with other compounds or components, such as mixtures of compounds. Further, when an amount, concentration, or other value or parameter is given as a list of upper values and lower values, this is to be understood as specifically disclosing all ranges formed from any pair of an upper value and a lower value, regardless of whether ranges are separately disclosed.

The terms "convert," "converting," "crack," and "cracking" are defined broadly herein to include any molecular decomposition, breaking apart, conversion, dehydrogenation, and/or reformation of hydrocarbon or other organic molecules, by means of at least pyrolysis heat, and can optionally include supplementation by one or more processes of catalysis, hydrogenation, diluents, stripping agents, and/or related processes.

In conventional facilities, different units separate the hydrocarbons into various streams. These units may include an atmospheric distillation unit, a vacuum distillation unit, a delayed coker, a hydrotreater, a merox treater, an isomerization unit, a catalytic reformer, a fluid catalytic cracker, an amine treater, a hydrocracker, and a pyrolysis reactor, such as a regenerative reactor or steam cracker. Typically, the hydrocarbon stream is passed through the atmospheric distillation unit to divide the hydrocarbons (e.g., crude oil) into gases, naphtha (e.g., light naphtha and heavy naphtha), kerosene/jet fuel, diesel oil, atmospheric gas oil and atmospheric resid or bottoms, each of these components being a specific portion of the hydrocarbon feed. The amount of these different products may vary based on the different crude oil provided for processing in the system. Some other conventional refinery facilities may also include a vacuum distillation unit, a hydrotreater, a merox treater, a delayed coker, a fluid catalytic cracker and a hydrocracker, which are used to further separate products, such as light vacuum gas oil, heavy vacuum gas oil and vacuum residuum.

Once the hydrocarbons have been separated, pyrolysis reactors are typically used to further process certain hydrocarbon streams to produce olefins. Olefins can be used to make other petrochemical products. A pyrolysis reactor can be a steam cracking furnace that can convert alkanes to alkenes and other byproducts. The alkenes can be separated from the byproducts and further processed into polyalkenes or other products.

FIG. 1 depicts a flow diagram of an example method 100 of processing a hydrocarbon stream in accordance with some aspects of the present disclosure. In particular, the FIG. 1 generally provides for:

- depressurizing an alkane stream to form a mixed phase stream at operation 102;
- vaporizing at least a portion of a non-vapor phase hydrocarbon of the mixed phase stream to form a vaporized stream comprising at least a portion of the mixed phase stream's hydrocarbon (that is vaporized during the vaporization) at operation 104;
- separating a first product and a second product from the vaporized stream, wherein the first product includes at least a portion of the vaporized stream's vapor phase hydrocarbon (that became vapor during the vaporization) and a non-vapor phase composition (e.g., remaining non-vapor phase droplets), and the second product includes at least a portion of the vaporized stream remaining as non-vapor during the vaporization at operation 106;
- removing at least a portion of the non-vapor phase droplets from the first product in a coalescer having coalescing elements to form a third product at operation 108; and
- pyrolysing a mixture of the third product with steam under pyrolysis conditions that include a temperature of about 815° C. to about 925° C. in a pyrolysis reactor to form the $C_{2+}$ unsaturates at operation 110

Figure 2:
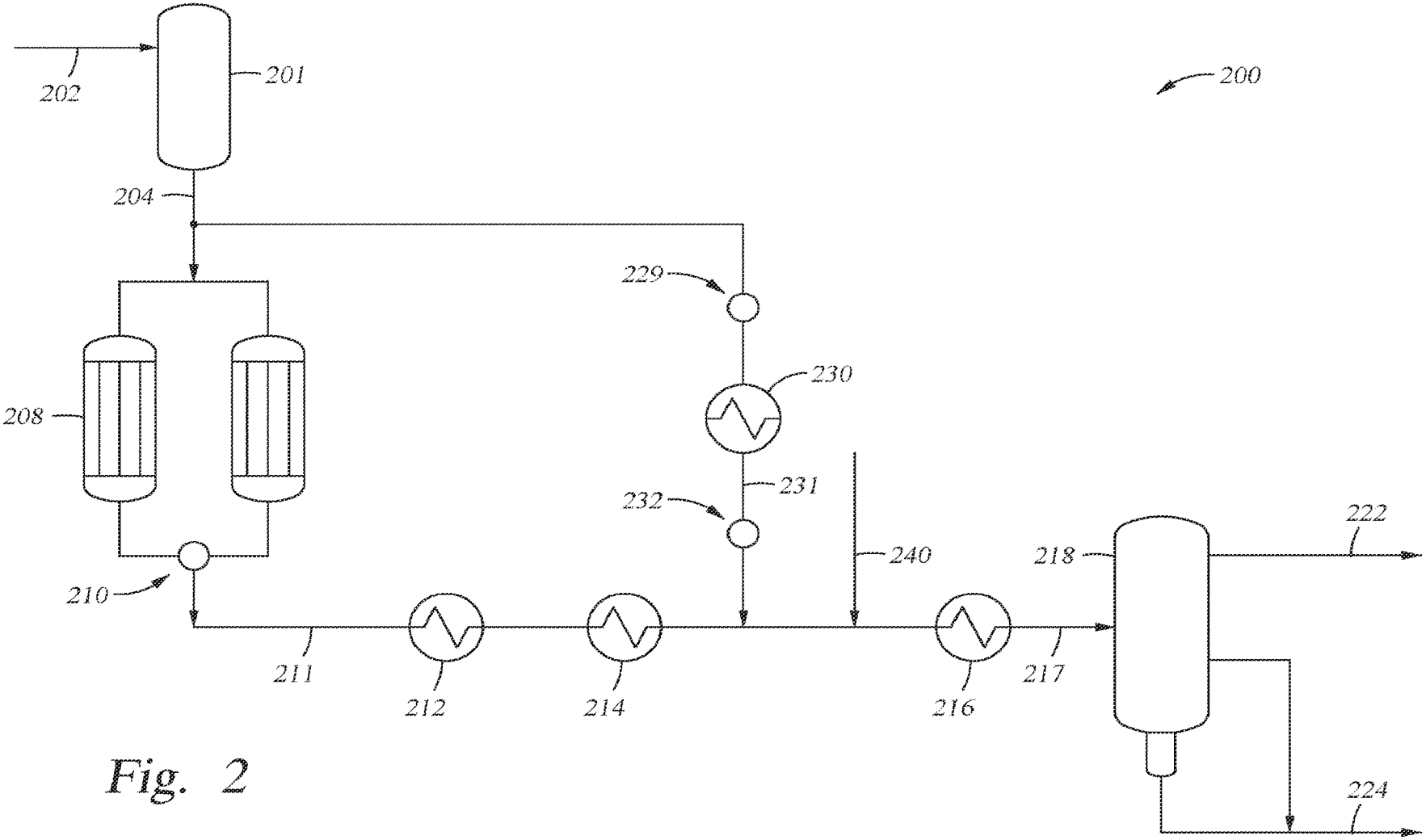
FIG. 2 depicts an example hydrocarbon processing system in accordance with some aspects of the present disclosure.

FIG. 2 depicts an example hydrocarbon processing system 200 in accordance with some aspects of the present disclosure. In some embodiments, a method of the present disclosure can be described with reference to the example hydrocarbon processing system 200 of FIG. 2. A hydrocarbon stream 202 is provided to be upgraded. The hydrocarbon stream 202 can a dense phase hydrocarbon stream having a density of about 290 kg/m$^3$ to about 410 kg/m$^3$. The hydrocarbon stream 202 comprises ≥75 wt. % hydrocarbon. The remaining non-hydrocarbon portion of the hydrocarbon stream 202 includes particulates, such as ≥90 wt. % of the non-hydrocarbon in the hydrocarbon stream is in the form of particulates. The provided hydrocarbon stream 202 is in a phase at which the hydrocarbon is miscible with at least a portion of the non-hydrocarbon portion of the stream. The hydrocarbon processing includes depressurizing the hydrocarbon stream 202, such as an alkane stream (e.g., operation 102 of FIG. 1) in depressurizer 210 to form a mixed phase stream 211. The depressurizer 210 can include one or more valves such as a "let-down" valve, turbo expansion devices and/or other suitable depressurizers. The hydrocarbon stream 202 can include a dense phase hydrocarbon including alkanes, such as ethane, propane or a combination thereof. The dense phase hydrocarbon can be provided via conduit or pipeline to the depressurizer 210 at a temperature of about 10° C. to about 35° C. In some embodiments, the depressurizer 210 includes a pressure valve for providing a pressure valve reading. The pressure valve reading before depressurizing can be about 5516 kPa to about 8274 kPa, such as about 6757 kPa to about 7584 kPa, such as about 6757 kPa to about 7101 kPa, such as about 6826 kPa, and/or at a temperature of about 10° C. to about 35° C., such as about 15° C. to about 35° C., such as about 15° C. to about 20° C., such as about 18.3° C. After depressurizing in operation 102, the pressure valve reading can be reduced to about 650 kPa to about 2500 kPa, such as about 689 kPa to about 2068 kPa, such as about 670 kPa to about 1380 kPa such as about 862 kPa and/or temperature of about −25° C. to about −40° C., such as about −20° C. to about −35° C. In some embodiments, the depressurizing operation 102 can be sufficient to adiabatically cool the hydrocarbon stream. The depressurizing operation may be performed to a sufficient level to vaporize at least a portion of the mixed phase stream. In some embodiments, the hydrocarbon stream 202 can be filtered in a filter 201 and dried in driers 208 prior to letting down the pressure in depressurizer 210. The driers 208 remove water to prevent plugging due to hydrate formation. The filter 201 can include about 5 μm filters, or the filters can have a larger surface area for hydrocarbon feeds that have an increased level(s) of contamination. After depressurizing, at least a portion of a non-vapor phase hydrocarbon of the mixed phase stream 211 can be vaporized in a first heat exchanger 212 to form a vaporized stream including at least a portion of the mixed phase stream's hydrocarbon that is vaporized during the vaporization (e.g., operation 104 of FIG. 1). The vaporized stream can have a gas density of about 9 kg/m$^3$ to about 22 kg/m$^3$, such as about 12 kg/m$^3$ to about 20 kg/m$^3$, such as about 15.6 kg/m$^3$. The first heat exchanger 212 can have a heat source that is provided by higher temperature fluid lines. The fluid lines can include a utility fluid including one or more of water (such as water provided to or from a boiler), ethane, ethylene, propane, propylene, such as propylene refrigerant from a unit downstream of a pyrolysis reactor, or any other suitable fluid, and/or a stream that is associated with another portion within the pyrolysis system or another system at the facility, such as a tower condenser service. The utility fluid can be provided at a temperature above the temperature of the mixed phase stream 211 and can provide indirect heat exchange with the mixed phase stream. In some embodiments, the first heat exchanger 212 can condense the utility fluid and vaporize at least a portion of a non-vapor phase hydrocarbon of the mixed phase stream 211. A second heat exchanger 214 in series with the first heat exchanger 212 can be used to further vaporize at least a second portion of a non-vapor phase hydrocarbon of the mixed phase stream 211. The second heat exchanger 214 can use a heat source including one or more of the utility fluids as described for the first heat exchanger 212. The temperature of the mixed phase stream 211 after the first and second heat exchangers 212, 214 can be from about 0° C. to about 32° C., such as about 10° C. to about 32° C., such as about 20° C. to about 32° C., alternatively about 0° C. to about 20° C.

Vaporizing the portion of the depressurized stream can include preheating depressurized stream in a preheater 216 at a temperature of about 38° C. to about 80° C., such as about 50° C. to about 80° C., such as from 50° C. to about 70° C., such as about 60° C. to provide a preheated mixed phase stream 217. In some embodiments, the depressurized stream is substantially vaporized after vaporizing. In some embodiments, the hydrocarbon stream is depressurized through two depressurizers. A first depressurizer 229 reduces the pressure of the hydrocarbon stream to an intermediate depressurized stream having a pressure of about 3100 kPa to 4481 kPa, as determined by a pressure reading on a pressure valve of the first depressurizer. In some embodiments, the first depressurizer 229 reduces the pressure of the hydrocarbon stream before vaporizer 230 which uses low pressure steam at a temperature of about 20° C. to about 50° C., such as about 25° C. to about 45° C., such as about 35° C. to about 45° C., such as about 38° C. and/or pressure at about 3100 kPa to about 4500 kPa, such as about 3100 kPa to about 4482 kPa, such as about 3447 kPa to about 4137 kPa, such about 3792 kPa. A vaporized portion of the intermediate depressurized stream can have a gas density of about 85 kg/m$^3$ to about 100 kg/m$^3$, and an unvaporized portion of the depressurized stream can have a liquid density of about 310 kg/m$^3$ to about 350 kg/m$^3$. The vaporized stream 231 is depressurized in a second depressurizer 232. The second depressurizer 232 reduces the pressure, as determined by a pressure reading on a pressure valve of the second depressurizer, at about 650 kPa to about 2100 kPa, such as about 689 kPa to about 2068 kPa, such as about 689 kPa to about 1379 kPa such as about 896 kPa to provide a depressurized stream. The depressurized stream can be further vaporized in heat exchanger 216 at a temperature of about 50° C. to about 100° C., such as about 50° C. to about 80° C., such as from 50° C. to about 70° C., such as about 60° C. to provide a preheated mixed phase stream 217.

A first and a second product can be separated from the vaporized stream, the first product can have at least a portion of the part of the vaporized stream's vapor phase hydrocarbon that became vapor during the vaporization, and the second product can include at least a portion of the vaporized stream remaining as non-vapor during the vaporization of the preheated mixed phase stream 217 (e.g., operation 106 of FIG. 1). Separating the first and second products from the vaporized stream can include filtering the vaporized portion of the mixed phase stream using cyclonic devices, vane pack devices, or knock-out drum with or without demister pads. In some embodiments, separating the first product and the second product from the mixed phase stream can include filtering the vaporized portion of the mixed phase stream with a gross separator section of a separating unit 218. Filtering the first product can include filtering particulates of about 10 μm or larger. In particular, greater than 80 wt. % of particles that are 3 μm or greater can be removed in the separating operation, such as greater than 90 wt. %, and/or greater than 90 wt. % of particles that are about 10 μm or greater, such as greater than 99 wt. % of particles that are 10 μm are greater can be removed in the separating operation.

As used herein, operation 106 can be referred to as "gross separation" to separate solid contamination, slugs, heavy hydrocarbons, glycol, water, and combinations thereof. Glycol can include monoethylene glycol, diethylene glycol, triethylene glycol, tetraethylene glycol, methanol, and other glycols. The inventors have discovered that sequencing the separation operation 106 after the depressuring operation 102 and the vaporizing operation 104, can provide separation of components. In particular, certain components, such as lube oil, is highly soluble in dense phase alkanes, such as ethane. By separating the components after depressuring and vaporizing, the components can be separated from one another. In some embodiments, greater than 20 wt. %, such as greater than 50 wt. %, such as about 50 wt. % of the total liquid removed from the mixed phase stream is removed in operation 106.

At least a portion of the non-vapor phase droplets can be removed from the first product in a coalescer to form a third product (e.g., operation 108). The coalescer can be a coalescer section of a separation unit 218. In some embodiments, greater than 20 wt. %, such as greater than 50 wt. %, such as about 50 wt. % of the total liquid removed from the mixed phase is removed in operation 108. The total liquid removed from the mixed phase in operations 106 and 108 is greater than 80 wt. %, such as 85 wt. % to about 99.99 wt. %, such as about 97 wt. % to about 99 wt. % of the incoming liquid from the mixed phase. In some embodiments, the coalescer can remove greater than 90 wt. % of droplets of from about 0.2 μm to about 1 μm from the filtered first product, such as about 0.3 μm to about 0.6 μm from the first filtered product to form a third product.

Figure 3A:
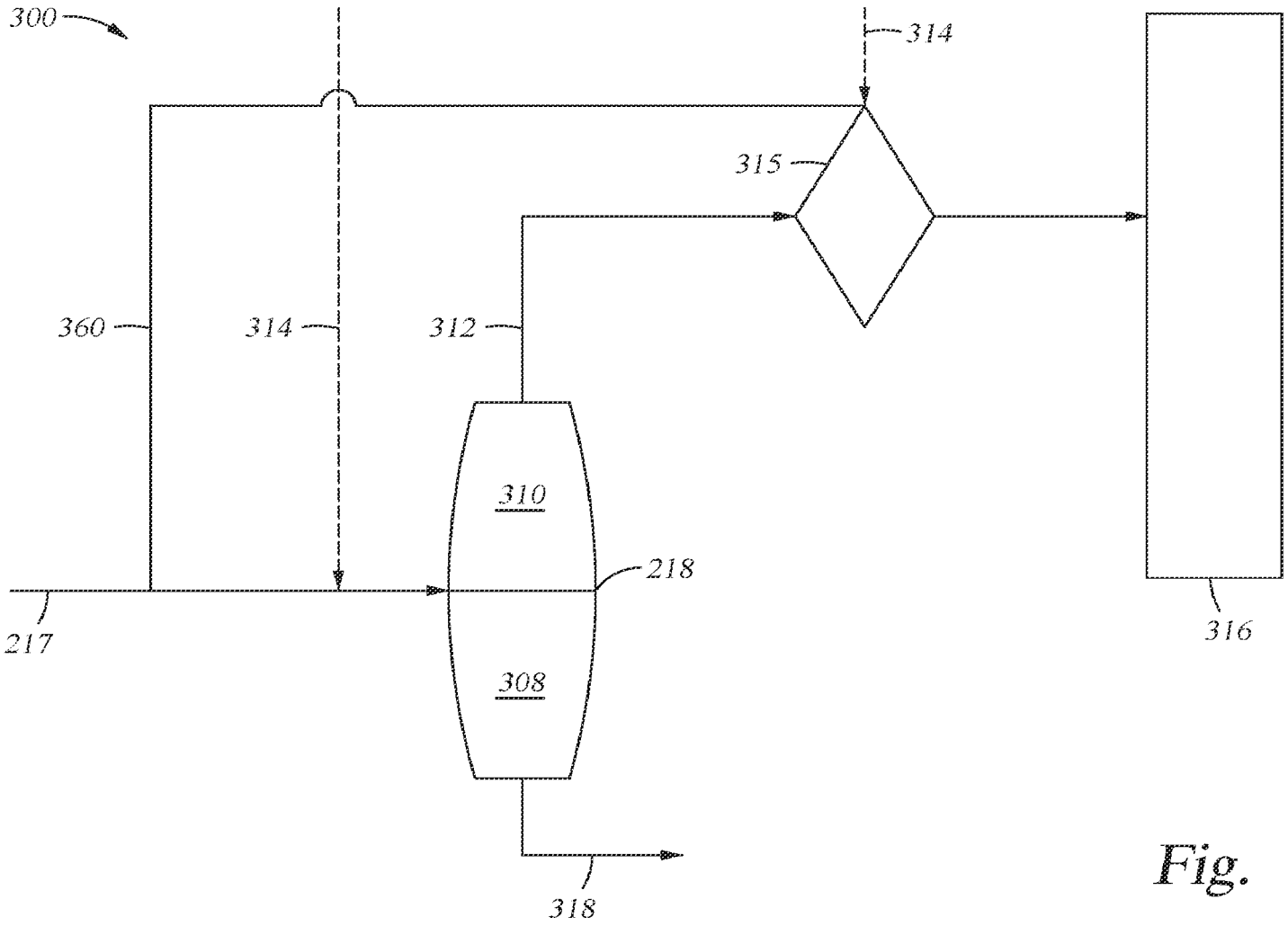
FIGS. 3A and 3B depict example separation systems in accordance with some aspects of the present disclosure.
Figure 3B:
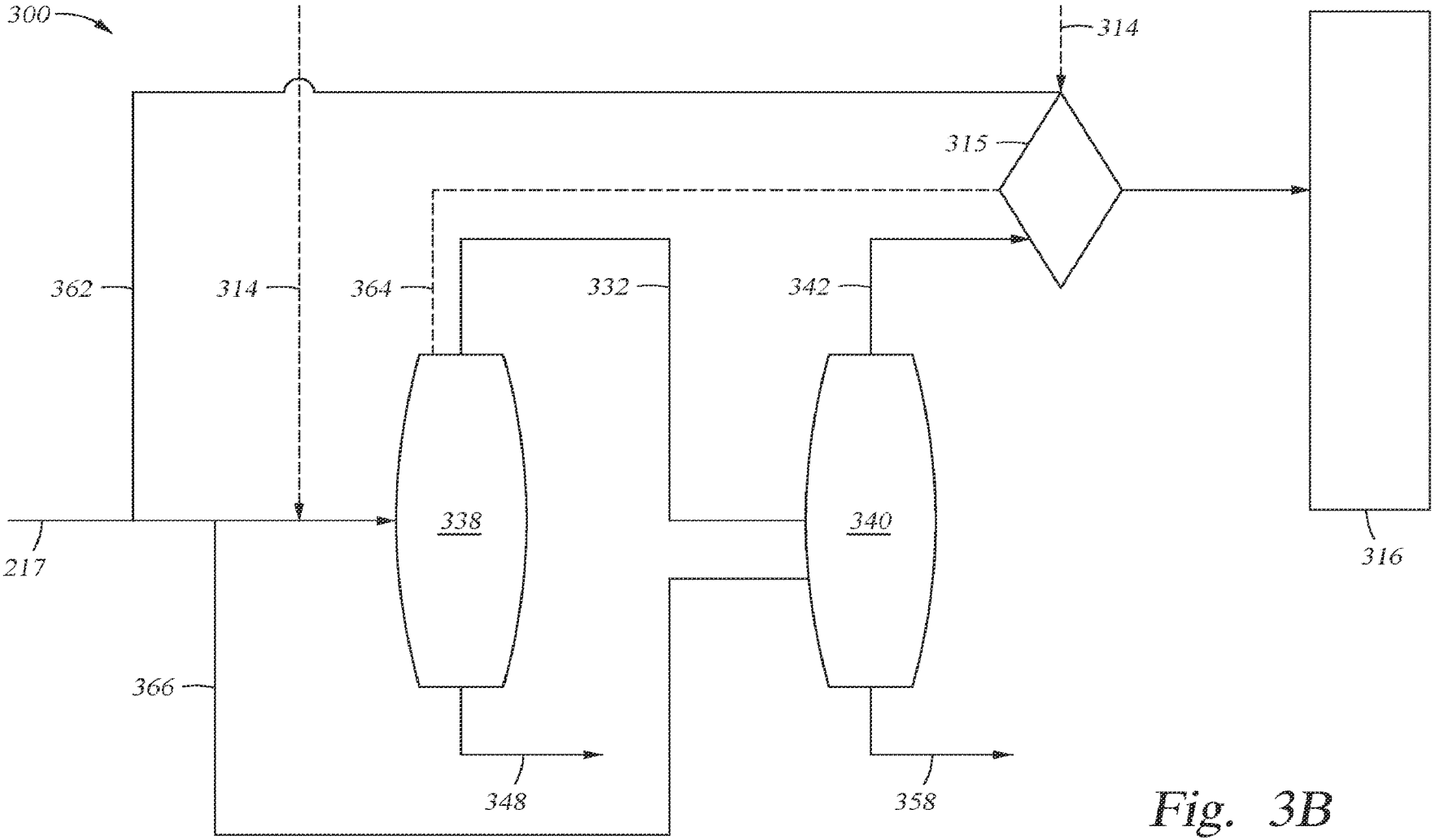

The coalescer can have coalescing elements such as borosilicate glass microfiber, or other suitable coalescing elements and/or cartridges. FIGS. 3A and 3B depict example separation systems 300 in accordance with some aspects of the present disclosure. In particular, FIG. 3A depicts the gross separator section 308 and the coalescer section 310 in a single separation unit 218. The separation unit 218 can produce a bottom stream 318 which can include contaminants such as particulates, heavy hydrocarbons, glycols, aerosols, slugs, and other components. In some embodiments, the glycol can be recovered and recycled. The separation unit can produce a top stream 312. The top stream 312 can enter into a pyrolysis reactor 316 for processing. The top stream 312 can have a density of about 8 kg/m$^3$ to about 12 kg/m$^3$, such about 9.8 kg/m$^3$. In some embodiments, the top stream 312 can enter into a mix point 315 followed by a heat exchanger, such as a convection section of a pyrolysis reactor 316. The mix point 315 can receive alkane splitter bottoms 314 that can be recycled before entering the pyrolysis reactor 316. The heat exchanger can include a bank of convection tubes. In some embodiments, the alkane splitter bottoms 314 can be recycled and mixed with the preheated mixed phase stream 217 at a location before the separation system. It has been found that in some processes, the alkane splitter bottoms 314 is substantially upgraded and can be processed in the pyrolysis reactor without entering a separation system 300.

FIG. 3B depicts the gross separator 338 and the coalescer 340 in series with one another. In operation, with reference to FIG. 1 and FIG. 2, the preheated mixed phase stream 217 can enter into a gross separator 338 for gross separation (e.g., operation 106). The gross separator 338 can be a flash drum, a knock-out drum, or other suitable drum or vessel with cyclonic devices, vane pack devices, or demister pads (CWMS) for separating vapor, liquid and solid materials. The gross separator 338 can have a gross separator bottom stream 348 and a gross separator top stream 332. The gross separator bottom stream 348 can have heavy components such as particulates and heavy hydrocarbons and the gross separator top stream 332 can be further processed in the coalescer 340 to remove droplets (e.g., operation 108). The coalescer 340 can have a coalescer bottom stream 358, which can include aerosol components. The coalescer 340 can include a coalescer top stream 342, which can include the third product to be preheated in a heat exchanger, such as a convection section of a pyrolysis reactor 316. A mixture of the third product with steam or preheated third product with steam can be heated (e.g., pyrolysed) in the pyrolysis reactor 316 under pyrolysis conditions (e.g., operation 110) to form $C_{2+}$ unsaturates, such as an alkene, such as ethylene. Prior to entering the pyrolysis reactor, the top stream 342 can enter into a mix point 315. The mix point 315 can receive alkane splitter bottoms 314 that can be recycled before entering the pyrolysis reactor 316. In some embodiments, the alkane splitter bottoms 314 can enter in a location before the separation system. It has been found that in some processes, the alkane splitter bottoms 314 is substantially upgraded (e.g., free of contaminants) and can be processed in the pyrolysis reactor without entering a separation system 300.

Figure 4:
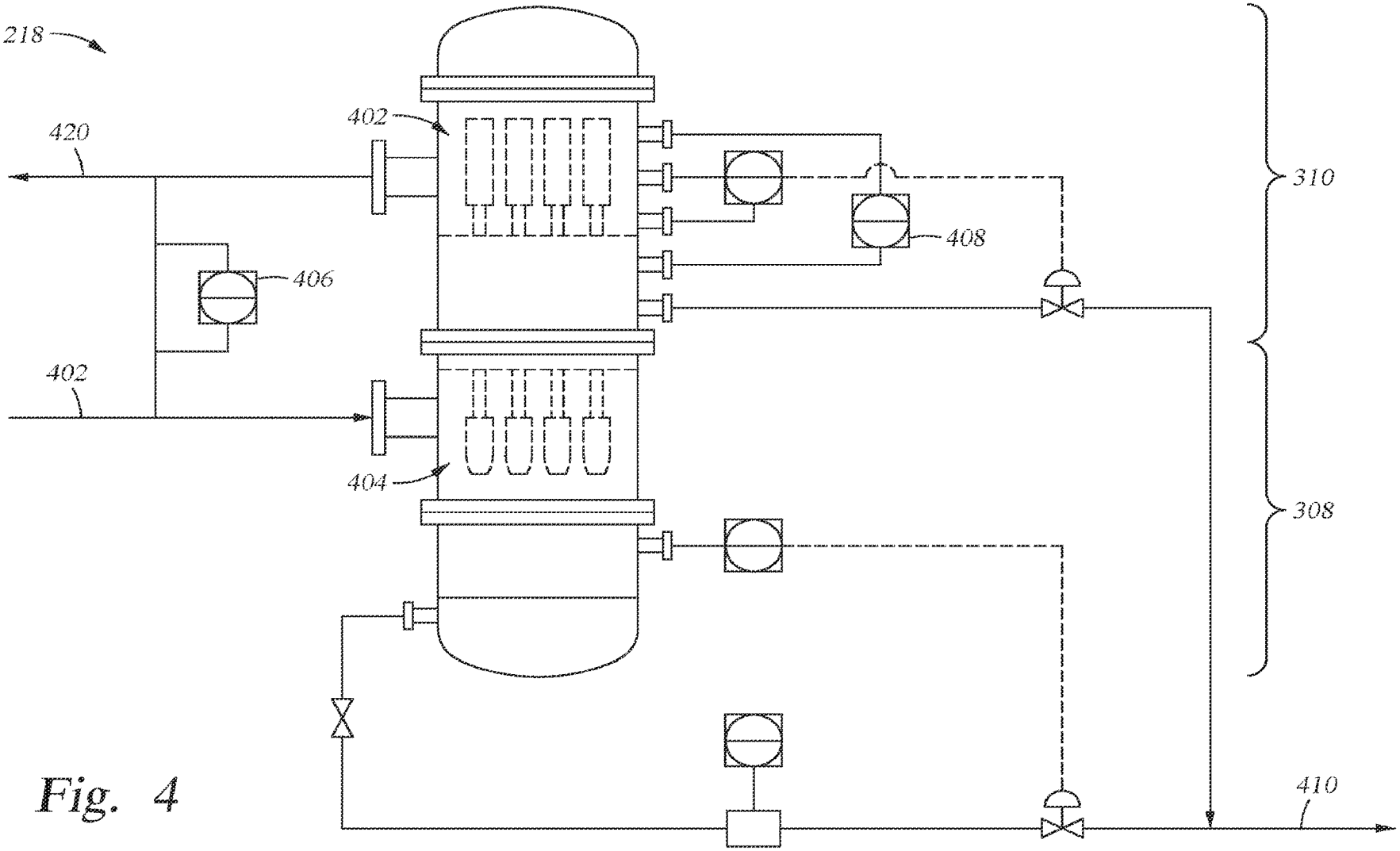
FIG. 4 depicts an example separation unit in accordance with some aspects of the present disclosure.

FIG. 4 depicts an example separation unit 218, in accordance with some aspects of the present disclosure. It is believed that sizing the separation unit 218, such as a gas-liquid cartridge coalescing vessel, may be a consideration in the design process. Oversizing a separation unit 218 can result in unnecessary initial materials costs and increased cost per change-out as the number of cartridge elements to be periodically replaced will be greater. Under sizing a separation unit 218 can result in liquid carryover and is less effective for removing contaminants. Generally, smaller separation units 218 have a higher frequency of cartridge element change outs, but each replacement is at lower costs. Considerations that are used to determine a size of the separation unit 218 can include process pressure, temperature, aerosol concentration, solid particulate loading, and process volumetric flow rate. In some embodiments, the separation unit 218 is sized based on a determination of a liquid phase volumetric rate on a per element basis for a given separation process. Vapor velocity through each element can also be considered. The number of elements in the separation unit 218 can be based on the efficiency of the elements depending on the type of element. Once the number of elements needed for separation is determined, a gas velocity in the annular space between the cartridge elements can be used to determine the size of the separation unit 218. The separation unit 218 is sized to be large enough to accommodate the necessary number of elements. In some embodiments, a superficial velocity of the vapor moving across an outer surface of the cartridge elements is kept low enough to avoid re-entrainment of the coalesced droplets. The superficial velocity design limit depends on the process material properties and thermodynamic conditions within the separation unit 218.

Because prefiltration and internal separation stages reduce liquid load on the elements, designing a coalescing vessel with these features in mind can reduce the number of elements used. Reduction in element count allows vessel diameter to be reduced without re-entraining the coalesced droplets. In this way, prefiltration and internal separation stages can reduce both the initial vessel cost as well as the operational cost as fewer elements are routinely replaced.

In some embodiments, the separation unit 218 can be about 6 feet to 8 feet in diameter, such as about 6.4 feet in diameter. The diameter of the separation unit 218 can be selected based on the total vapor flow rate entering the separation unit 218. For example, the capacity of the separation unit 218 can be about 700 klb/hr to about 750 klb/hr, such as about 725 klb/hr.

Process parameters that can be considered when designing separation units 218 can include flow rate, operating temperature, design temperature, operating pressure, design pressure, specific gravity of gas, gas composition, gas viscosity at conditions, gas density at conditions, liquid aerosol composition, liquid aerosol concentration, liquid aerosol density at conditions, liquid aerosol viscosity at conditions, interfacial tension between gas and liquid phases at conditions, solids concentration, frequency and magnitude of upsets, desired clean, pressure drop across coalescer vessel, existing pipe diameter, and combinations thereof.

In some embodiments, the design pressure can be about 1172 kPa to about 2068 kPa, such as about 1379 kPa to about 1793 kPa, such as about 1586 kPa. The separation unit 218 can have a critical exposure temperature (CET) of about −50° C. to about −40° C. such as about −45° C. The separation unit 218 can have a gross separation section 308 and a coalescer section 310. In some embodiments the gross separation section 308 can use inertial separation principles such as cyclones, vane separators and mesh pads.

The separation unit 218 can be modified to have a full diameter flanged top to access the coalescing elements 402 without entering the vessel as opposed to the standard manway access points. A flanged top can provide quicker and safer access to the coalescing elements 402 for replacement. Thus, the coalescing elements 402 can be changed out without entering the separation unit 218 and can provide additional ease of access. The separation unit 218 can be a mechanical process vessel with high-surface area packing on which aerosols and liquid droplets can consolidate for gravity separation from the alkane gas. The separation unit 218 can remove the droplets by direct interception (sieving) and diffusional interception. It is believed that the random motion of fine aerosol droplets increases the probability that the droplets will collide with the coalescing elements and coalesce together. Thus, as the gas flow rate through the separation unit 218 decreases, the removal efficiency can increase.

During operation, the pressure differential across the coalescer can be monitored using a pressure instrument. When the pressure drop reaches a predetermined pressure drop limit, the separation unit (e.g., 218) can be bypassed via bypass conduit 360, and the coalescing elements can be replaced. The predetermined pressure drop limit can be a separation unit pressure drop differential measurement 406 measured as the difference between the pressure reading prior to entering the separation unit and the pressure reading after exiting the separation unit. In some embodiments, the coalescer pressure differential measurement 408 can be measured inside the coalescer section 310 before and after processing the vapor stream through the coalescing elements. The predetermined pressure drop limit can be greater than 48 kPa, such as about 55 kPa to about 345 kPa, such as about 69 kPa to about 138 kPa, such about 69 kPa to about 103 kPa, or about 69 kPa to about 83 kPa, such as about 69 kPa. In some embodiments, the separation unit 218 operates at about 30° C. to about 90° C., such as about 35° C. to about 70° C., such as about 50° C. to about 65° C.

Bypassing the separation unit can provide continued processing of hydrocarbon without the need for downtime. In some embodiments, as depicted in FIG. 3B, a bypass system can include a bypass conduit 362 to bypass the gross separator 338 and the coalescer 340. In some embodiments, the bypass system can include a gross separator bypass 366 to bypass the gross separator 338. In some embodiments, the bypass system can include a coalescer bypass 364. The coalescer bypass 364 can be used to bypass the coalescer 340. In some embodiments, the coalescing elements can be replaced and/or the coalescer can be cleaned by draining, cleared, and steamed to a warm liquid drain. Clearing the coalescer can include delivering steam such as water or nitrogen via hoses. In some embodiments, the design temperature of the coalescing elements is about 80° C. to about 100° C., such as about 90° C. to about 95° C. The temperature of the steam can be less than the design temperature of the coalescing elements, such as at least 5° C. below the design temperature, such as about 5° C. to about 10° C. less than the design temperature of the coalescing elements, or at least 10° C. below the design temperature of the coalescing elements. One or more of the bypass conduits can be about 10 inches to about 30 inches, such as about 20 to 30 inches in diameter, such as about 24 inches to about 26 inches, such as about 24 inches. The bypass conduit can be sized based on the size of the coalescer. In some embodiments, the separation unit 218 can be brought back into service after replacing the coalescing elements by reducing the vapor feed flow, shutting off the bypass system, such as by closing a bypass valve, and ramping the vapor feed flow back while monitoring pressure differentials of the separation unit. In some embodiments, the total vapor feed flow rate is about 300 klb/hr to about 500 klb/hr, such as from 350 klb/hr to about 450 klb/hr, such as about 400 klb/hr to about 425 klb/hr.

The third product can be heated to form a fourth product. The third product can be heated at about 650° C. to about 760° C., such as about 670° C. to about 750° C. through a heat exchanger such as a convection section of a pyrolysis reactor (e.g., operation 110). The fourth product can be processed in a radiant section of the pyrolysis reactor (e.g., operation 112) to form a fifth product. In particular, the fourth product can be heated at a temperature of about 815° C. to about 925° C. in a pyrolysis reactor to convert the fourth product to various alkenes, such as ethylene, propylene, acetylene, and combinations thereof.

EXAMPLE

A separation system was installed in an ethane processing facility downstream of the depressurizer and vaporizer as described with reference to FIG. 2 and FIG. 3A. A sample boot was coupled to the separation unit to collect samples of the contaminants. The sample boot had a capacity of about 57 lbs of heavy hydrocarbon and/or glycol. Ethane was flowed through the separation unit at a total flow rate of 450 klb/hr. About 50 wt. % of the liquid was knocked out in the cyclone (e.g., gross separation) section of the separation unit, which the remaining liquid removed in the coalescer.

The ethane processing facility was operated over several months with the separation unit in place. No early steam air decokes were experienced due to high radiant coking rate, resulting in reduced number of offline decokes. Along with improved furnace reliability, 8 kTa ethylene production credit for 0.05 steam to hydrocarbon reduction was captured. Heavy hydrocarbon liquids, lab identified as compressor lube oil, were collected from both the cyclone and coalescing element sections of the separation unit.

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

What is claimed is:

1. A hydrocarbon pyrolysis process, comprising:

vaporizing at least a portion of a non-vapor phase hydrocarbon of a hydrocarbon stream to form a second stream comprising at least a portion of a vaporized stream formed during the vaporization, wherein the vaporization includes depressurizing the hydrocarbon stream by establishing a flow of the hydrocarbon stream through a valve from a first pressure of about 5515 kPa to about 8274 kPa upstream of the valve to a second pressure of about 689 kPa to about 2068 kPa downstream of the valve;

separating a first product and a second product from the second stream, wherein (i) the first product comprises at least a portion of the vaporized stream formed during vaporization and at least a portion of any non-vapor phase compositions, and (ii) the second product comprises at least a portion of the second stream remaining as non-vapor during the vaporization;

removing the at least a portion of any non-vapor phase compositions from the first product to form a third product; and pyrolysing at least a portion of the third product to produce a fourth product comprising saturated and unsaturated hydrocarbon.

2. The method of claim 1, wherein the hydrocarbon stream comprises ethane, propane, or a combination thereof.

3. The method of claim 1, wherein (i) the separation includes filtration, and (ii) the second product comprises particulates having a size ≥10 μm.

4. The method of claim 3, wherein at least part of the filtration is carried out in one or more of a knockout drum with or without demister pads (CWMS), a cyclonic device, and a vane pack device.

5. The method of claim 3, wherein the filtration transfers to the second product (i) ≥90 wt. % of particulates having a size in a range of from at least 3 μm to less than 10 μm and (ii) ≥99 wt. % of the particulates having a size ≥10 μm.

6. The method of claim 1, wherein the hydrocarbon stream comprises ethane, and the hydrocarbon stream has a density of about 280 $kg/m^3$ to 410 $kg/m^3$.

7. The method of claim 1, wherein (i) the removal of at least a portion of any non-vapor phase compositions from the first product comprises removing at least a portion of liquid-phase droplets in the first product, and (ii) the droplet removal is carried out at least in part by droplet coalescence in the presence of a coalescing element capable of removing from the first product ≥99 wt. % of droplets having a size in a range of from 0.3 μm to about 0.6 μm.

8. The method of claim 7, wherein the coalescing element comprises borosilicate.

9. The method of claim 1, further comprising mixing the third product and a recycle stream before the pyrolysis, wherein the recycle stream comprises at least a portion of the fourth product's saturated hydrocarbon.

10. The method of claim 1, further comprising mixing (i) a recycle stream and (ii) the second stream and/or the first product, wherein the mixing is carried out before the removal of non-vapor phase compositions, and wherein the recycle stream comprises at least a portion of the fourth product's saturated hydrocarbon.

11. The method of claim 1, wherein non-vapor phase compositions comprise water, C3+ hydrocarbons, glycol, or combination(s) thereof.

12. The method of claim 1, further comprising indirectly heating the third product before the pyrolysis.

13. The method of claim 1, wherein depressurizing further comprises reducing a first temperature of the hydrocarbon stream before depressurizing to a second temperature, wherein the first temperature is about 10° C. to about 35° C. the second temperature is about −25° C. to about −40° C.

14. The method of claim 13, wherein the temperature of the hydrocarbon stream is reduced by depressurizing the hydrocarbon under adiabatic conditions.

15. A method of producing an alkene comprising:

depressurizing an alkane stream to form a mixed phase stream comprising a non-vapor phase hydrocarbon;

vaporizing at least a portion of the non-vapor phase hydrocarbon to form a vaporized stream;

separating a first product and a second product from the vaporized stream, wherein (i) the first product comprises at least a portion of the vaporized stream and non-vapor phase droplets, and (ii) the second product comprises at least a portion of the vaporized stream remaining as non- vapor during the vaporization, wherein the separation includes filtration carried out in one or more knock-out drums optionally having a demister pad, a cyclonic device, a vane pack device, or combination(s) thereof;

removing the non-vapor phase droplets from the first product in a coalescer comprising coalescing elements to form a third product;

pyrolysing a mixture of the third product with steam under pyrolysis conditions that include a temperature in a range of from about 815° C. to about 925° C. to produce C2+ unsaturates.

16. A hydrocarbon processing system comprising:

a depressurization unit configured to reduce a pressure of a hydrocarbon stream;

a vaporization unit in fluid communication with the depressurization unit and configured to vaporize at least a portion of a non-vapor phase hydrocarbon of the hydrocarbon stream;

a separation system in fluid communication with the vaporization unit, the separation system comprising a coalescing element; and a pyrolysis reactor in fluid communication with the separation system.

17. The system of claim 16, wherein the separation system comprises:

a phase separator configured to separate particulates having a size ≥10 μm from a first product that includes at least a portion of a vaporized portion of the stream; and a coalescer comprising coalescing elements configured to remove liquid-phase droplets having a size ≥0.3 μm from the first product.

18. The system of claim 17, wherein the phase separator comprises a knockout drum, a cyclonic device, a vane pack device, a knock-out drum with demister pad, or combination(s) thereof.

19. The system of claim 17, wherein the phase separator and the coalescer are disposed in a single separating unit.

20. The system of claim 16, further comprising a feed preheater coupled to the separation system.

21. The system of claim 16, further comprising a heat exchanger in fluid communication with the depressurization unit, the heat exchanger configured to heat the hydrocarbon stream.

22. The system of claim 16, wherein the coalescing element comprise borosilicate.

23. The system of claim 16, further comprising a bypass system configured to direct the stream from the vaporization unit to the pyrolysis reactor.

24. A system for producing alkenes from alkanes comprising:

a heat exchanger in fluid communication with an alkane stream feed and configured to heat an alkane stream;

a depressurization unit in fluid communication with the heat exchanger and configured to reduce a pressure of the alkane stream;

a vaporizing unit in fluid communication with the depressurization unit and configured to vaporize at least a portion of a non-vapor phase hydrocarbon of the alkane stream;

a separation system in fluid communication with the vaporizing unit, the separation system comprising coalescing elements; and a pyrolysis reactor in fluid communication with the separation system.

* * * * *